US008936102B2

(12) United States Patent
Rood

(10) Patent No.: US 8,936,102 B2
(45) Date of Patent: Jan. 20, 2015

(54) PACKER ASSEMBLY HAVING BARREL SLIPS THAT DIVERT AXIAL LOADING TO THE WELLBORE

(71) Applicant: Halliburton Energy Services, Inc., Houston, TX (US)

(72) Inventor: Dennis Dean Rood, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/222,650

(22) Filed: Mar. 23, 2014

(65) Prior Publication Data

US 2014/0299332 A1 Oct. 9, 2014

(51) Int. Cl.
*E21B 33/129* (2006.01)
*E21B 33/13* (2006.01)

(52) U.S. Cl.
CPC ..... *E21B 33/1293* (2013.01); *E21B 33/13* (2013.01)
USPC ..... 166/387; 166/118

(58) Field of Classification Search
CPC ..... E21B 33/1292; E21B 33/1293
USPC ..... 166/387, 118–203
See application file for complete search history.

(56) References Cited

U.S. PATENT DOCUMENTS 3,195,642 A * 7/1965 Conrad ..... 166/134
3,520,361 A * 7/1970 Lewis ..... 166/134
4,921,045 A 5/1990 Richardson
5,906,240 A 5/1999 Kilgore et al.
5,944,102 A 8/1999 Kilgore
6,056,052 A 5/2000 Mullen
2002/0088616 A1 7/2002 Swor et al.
2003/0034159 A1 * 2/2003 Weinig et al. ..... 166/120
2005/0028989 A1 * 2/2005 Doane et al. ..... 166/380
2005/0189120 A1 * 9/2005 Doane et al. ..... 166/387
2005/0189121 A1 * 9/2005 Doane et al. ..... 166/387
2007/0261863 A1 * 11/2007 MacLeod et al. ..... 166/387
2008/0196884 A1 * 8/2008 Doane et al. ..... 166/134
2011/0147013 A1 6/2011 Kilgore

OTHER PUBLICATIONS

ISRWO, PCT/US2013/035774, KIPO, Jan. 8, 2014.

* cited by examiner

*Primary Examiner* — Blake Michener

(57) ABSTRACT

A barrel slip for a packer assembly operable for use in a wellbore. The barrel slip includes a radially expandable barrel slip body having a first end and a second end. A substantially cylindrical directional gripping surface is disposed on an exterior of the barrel slip body proximate the first end. A substantially cylindrical non directional contact surface is disposed on the exterior of the barrel slip body proximate the second end. In a set configuration, radial expansion of the barrel slip body creates a gripping engagement between the directional gripping surface and the wellbore that opposes movement of the barrel slip body in a first direction. Also, in the set configuration, radial expansion of the barrel slip body creates a contact engagement between the non directional contact surface and the wellbore that diverts force acting on the barrel slip body in a second direction to the wellbore.

19 Claims, 7 Drawing Sheets

PACKER ASSEMBLY HAVING BARREL SLIPS THAT DIVERT AXIAL LOADING TO THE WELLBORE

CROSS-REFERENCE TO RELATED APPLICATIONS

This application claims the benefit under 35 U.S.C. §119 of the filing date of International Application No. PCT/US2013/035774, filed Apr. 9, 2013.

TECHNICAL FIELD OF THE INVENTION

This invention relates, in general, to equipment utilized in conjunction with operations performed in relation to completing subterranean wells for hydrocarbon fluid production and, in particular, to a packer assembly for high pressure operations that has opposing barrel slips that divert axial loading to the wellbore.

BACKGROUND OF THE INVENTION

Without limiting the scope of the present invention, its background will be described in relation to setting packers, as an example.

In the course of completing a subterranean well for hydrocarbon production, one or more packers are commonly installed in the well. The purpose of the packers is to support production tubing and other completion equipment and to provides a seal in the well annulus between the outside of the production tubing and the inside of the well casing to isolate fluid and pressure thereacross.

Certain production packers are set hydraulically by establishing a differential pressure across a setting piston. This may be accomplished, for example, by running a tubing plug on wireline, slick line, electric line, coiled tubing or another conveyance into the production tubing to a profile location. Fluid pressure within the production tubing may then be increased, thereby creating a pressure differential between the fluid within the production tubing and the fluid in the wellbore annulus. This pressure differential actuates a setting piston to axially compress and radially expand one or more seal elements of the production packer into sealing engagement with the casing. In addition, the force generated by the setting piston may be used radially expand one or more slip elements of the production packer into gripping engagement with the casing. Thereafter, the tubing plug is retrieved to the surface such that production operations may begin.

As operators increasingly pursue production in deeper water offshore wells, highly deviated wells and extended reach wells, for example, it has been found that production packers must be able to operate in increasingly higher operating pressures and under increasing axial forces. One limiting factor associated with production packers is the collapse strength of the packer mandrel. In the case of retrievable production packers having a single barrel slip, axial forces applied to the packer mandrel in addition to, for example, differential pressures in the well, translate to increased pressure on the packer mandrel proximate the seal elements. If the combined loading on the packer mandrel caused by the applied axial forces and the force generated by the differential pressures exceeds the collapse strength of the packer mandrel, a failure may occur. As such, it has been found, that some retrievable production packers having a single barrel slip are not suitable for certain high pressure operations.

Accordingly, a need has arisen for improved packer assembly for providing a seal between a tubular string and a wellbore surface. In addition, a need has arisen for such an improved packer assembly that is operable for use in higher pressure well operations.

SUMMARY OF THE INVENTION

The present invention disclosed herein comprises a packer assembly having opposing barrel slips that divert axial loading. The packer assembly of the present invention is operable for providing a seal between a tubular string and a wellbore surface. In addition, the packer assembly of the present invention is operable for use in higher pressure well operations.

In one aspect, the present invention is directed to a packer assembly for use in a wellbore. The packer assembly includes a packer mandrel, first and second barrel slips that are disposed about the packer mandrel and a seal assembly that is disposed about the packer mandrel between the first and second barrel slips. The first barrel slip has a first directional gripping surface and a first non directional contact surface. The second barrel slip has a second directional gripping surface and a second non directional contact surface. In a set configuration, radial expansion of the seal assembly creates a sealing engagement between the seal assembly and the wellbore. Also, in the set configuration, radial expansion of the first barrel slip creates a gripping engagement between the first directional gripping surface and the wellbore that opposes movement of the first barrel slip in a first direction and a contact engagement between the first non directional contact surface and the wellbore that diverts force acting on the first barrel slip in a second direction to the wellbore. In addition, in the set configuration, radial expansion of the second barrel slip creates a gripping engagement between the second directional gripping surface and the wellbore that opposes movement of the second barrel slip in the second direction and a contact engagement between the second non directional contact surface and the wellbore that diverts force acting on the second barrel slip in the first direction to the wellbore.

In one embodiment, a setting piston is slidably disposed about the packer mandrel forming a setting chamber therebetween. In this embodiment, pressurizing the setting chamber actuates the setting piston to shifts the packer assembly from a running configuration to the set configuration. In some embodiments, the first and second barrel slips may each include a radially expandable barrel slip body having a first end, a second end, a plurality of first longitudinal slots extending from the first end and terminating near the second end and a plurality of second longitudinal slots extending from the second end and terminating near the first end. In one embodiment, each of the first and second directional gripping surfaces may include a substantially cylindrical surface having a plurality of teeth and each of the first and second non directional contact surfaces may include a substantially cylindrical surface having a substantially smooth finish. In another embodiment, each of the first and second directional gripping surfaces may include a substantially cylindrical surface having a plurality of teeth and each of the first and second non directional contact surfaces may include a substantially cylindrical surface having a friction enhancing finish.

In certain embodiments, the first non directional contact surface may be operable to divert at least ten percent of the force acting on the first barrel slip in the second direction to the wellbore and the second non directional contact surface may be operable to divert at least ten percent of the force acting on the second barrel slip in the first direction to the wellbore. In other embodiments, the first non directional contact surface may be operable to divert at least twenty five percent of the force acting on the first barrel slip in the second direction to the wellbore and the second non directional contact surface may be operable to divert at least twenty five percent of the force acting on the second barrel slip in the first direction to the wellbore. In still other embodiments, the first non directional contact surface may be operable to divert at least fifty percent of the force acting on the first barrel slip in the second direction to the wellbore and the second non directional contact surface may be operable to divert at least fifty percent of the force acting on the second barrel slip in the first direction to the wellbore.

In another aspect, the present invention is directed to a barrel slip for a packer assembly operable for use in a wellbore. The barrel slip includes a radially expandable barrel slip body having a first end, a second end, a plurality of first longitudinal slots extending from the first end and terminating near the second end and a plurality of second longitudinal slots extending from the second end and terminating near the first end. A substantially cylindrical directional gripping surface is disposed on an exterior of the barrel slip body proximate the first end. A substantially cylindrical non directional contact surface is disposed on the exterior of the barrel slip body proximate the second end. In a set configuration, radial expansion of the barrel slip body creates a gripping engagement between the directional gripping surface and the wellbore that opposes movement of the first barrel slip in a first direction and a contact engagement between the non directional contact surface and the wellbore that diverts force acting on the barrel slip body in a second direction to the wellbore.

In one embodiment, the directional gripping surface may include a plurality of teeth and the non directional contact surface may include a substantially smooth finish. In another embodiment, the directional gripping surface may include a plurality of teeth and the non directional contact surface may include a friction enhancing finish. In certain embodiments, the non directional contact surface may be operable to divert at least ten percent of the force acting on the barrel slip body in the second direction to the wellbore. In other embodiments, the non directional contact surface may be operable to divert at least twenty five percent of the force acting on the barrel slip body in the second direction to the wellbore. In further embodiments, the non directional contact surface may be operable to divert at least fifty percent of the force acting on the barrel slip body in the second direction to the wellbore.

In a further aspect, the present invention is directed to a method for diverting axial loading to a wellbore from a packer assembly. The method includes providing a packer assembly having a packer mandrel with a seal assembly, a first barrel slip and a second barrel slip disposed thereabout; running the packer assembly into the wellbore; actuating the packer assembly from a running configuration to a set configuration; establishing a sealing engagement between the seal assembly and the wellbore; establishing a gripping engagement between a directional gripping surface of the first barrel slip and the wellbore that opposes movement of the first barrel slip in a first direction; establishing a contact engagement between a non directional contact surface of the first barrel slip and the wellbore that diverts force acting on the first barrel slip in a second direction to the wellbore; establishing a gripping engagement between a directional gripping surface of the second barrel slip and the wellbore that opposes movement of the second barrel slip in the second direction; and establishing a contact engagement between a non directional contact surface of the second barrel slip and the wellbore that diverts force acting on the second barrel slip in the first direction to the wellbore.

The method may also include pressurizing a setting chamber to shift a setting piston; engaging a substantially cylindrical surface having a plurality of teeth of the first barrel slip and the wellbore; engaging a substantially cylindrical surface having a plurality of teeth of the second barrel slip and the wellbore; engaging a substantially cylindrical surface having a substantially smooth finish of the first barrel slip and the wellbore; engaging a substantially cylindrical surface having a substantially smooth finish of the second barrel slip and the wellbore; and/or engaging a substantially cylindrical surface having a friction enhancing finish of the first barrel slip and the wellbore and engaging a substantially cylindrical surface having a friction enhancing finish of the second barrel slip and the wellbore.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention and do not delimit the scope of the present invention.

Figure 1:
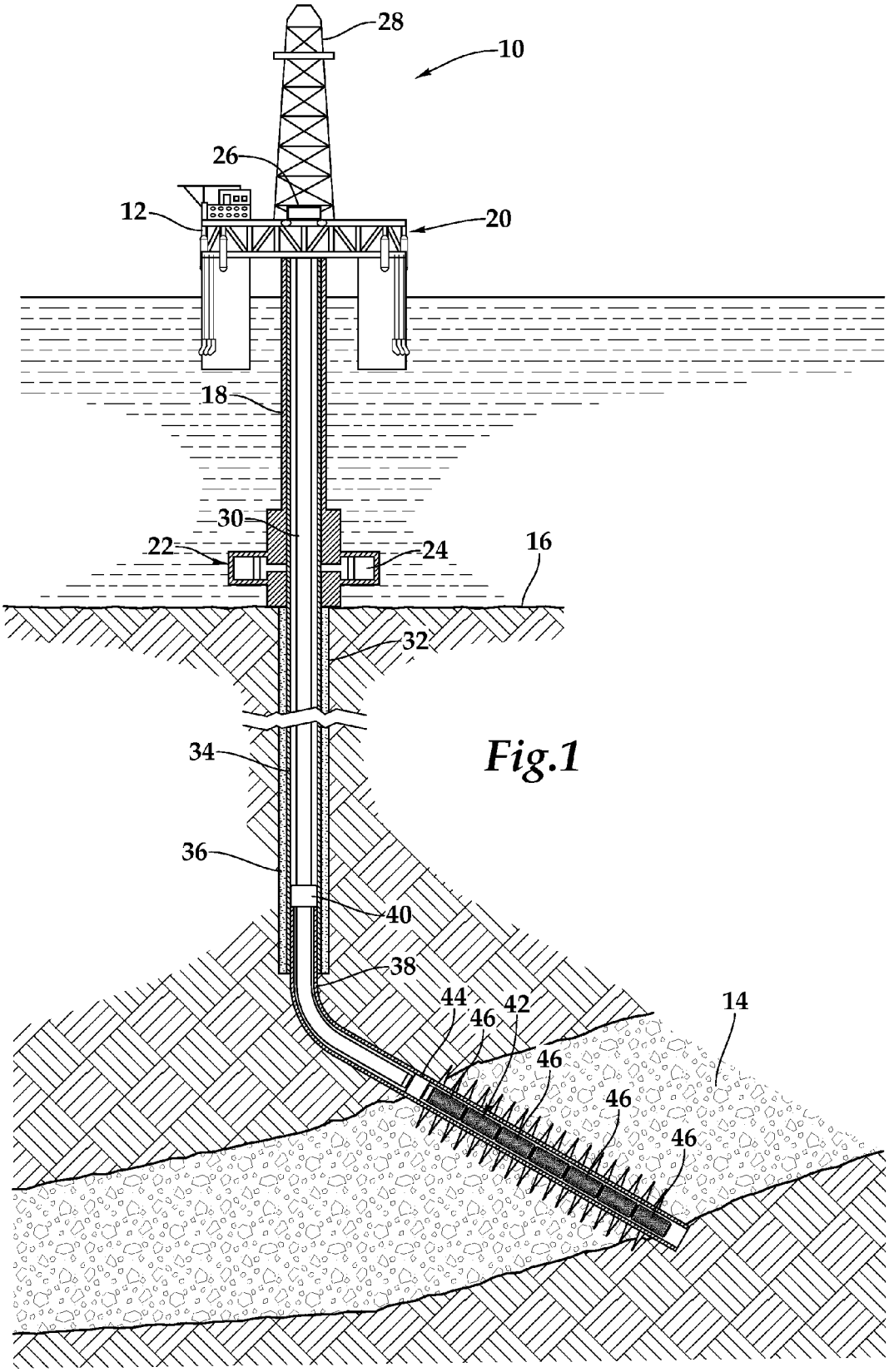
FIG. 1 is a schematic illustration of an offshore platform operating a packer assembly having opposing barrel slips that divert axial loading to the wellbore in accordance with an embodiment of the present invention.

Referring initially to FIG. 1, a packer assembly having opposing barrel slips that divert axial loading to the wellbore has been installed in an offshore well that is schematically illustrated and generally designated 10. A semi-submersible platform 12 is centered over a submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings, such as work string 30.

A wellbore 32 extends through the various earth strata including formation 14. A casing 34 is secured within a vertical section of wellbore 32 by cement 36. A liner 38 is secured to the lower end of casing 34 by a suitable liner hanger 40. Note that, in this specification, the terms "liner" and "casing" are used interchangeable to describe tubular materials, which are used to form protective linings in wellbores. Liners and casings may be made from any material such as metals, plastics, composites, or the like, may be expanded or unexpanded as part of an installation procedure. Additionally, it is not necessary for a liner or casing to be cemented in a wellbore.

Work string 30 includes a completion string 42 on its lower end. In the illustrated embodiment, completion string 42 includes a packer assembly 44 that has opposing barrel slips that divert axial loading to liner 38 when packer assembly 44 is set. In addition, completion string 42 includes a plurality of sand control screen assemblies 46 that are located proximate formation 14.

Even though FIG. 1 depicts the present invention in a slanted wellbore, it should be understood by those skilled in the art that the present invention is equally well suited for use in wellbores having other directional configurations including vertical wellbores, horizontal wellbores, deviated wellbores, multilateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an offshore operation, it should be understood by those skilled in the art that the present invention is equally well-suited for use in onshore operations.

Figure 2A:
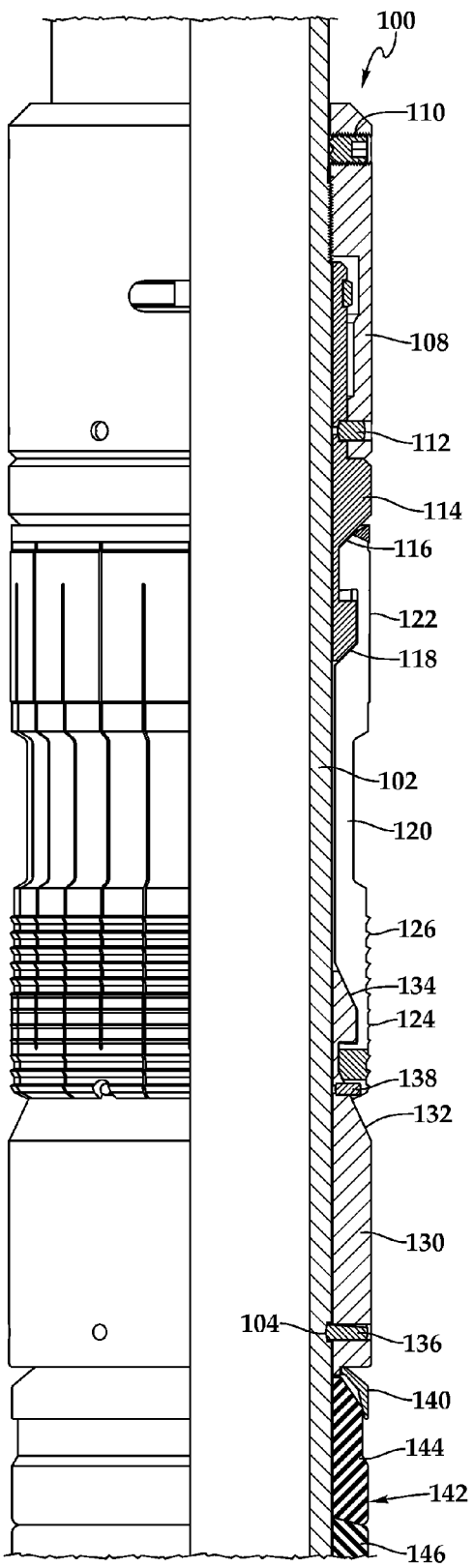
FIGS. 2A-2C are quarter-sectional views of consecutive axial sections of a packer assembly having opposing barrel slips that divert axial loading to the wellbore in accordance with an embodiment of the present invention in its running configuration.
Figure 3A:
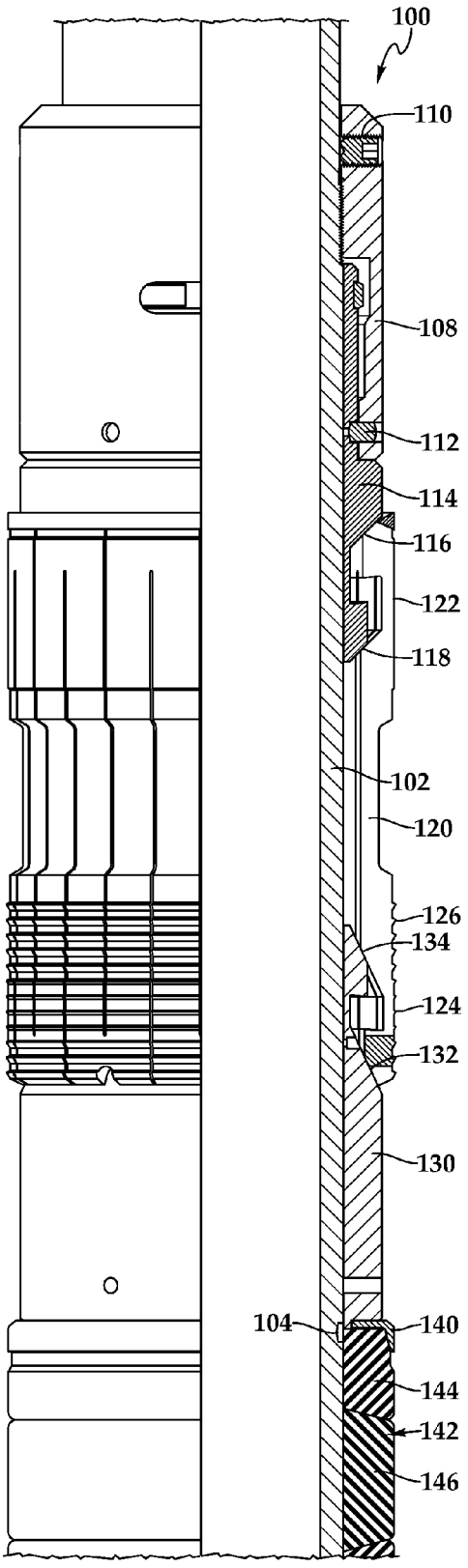
FIGS. 3A-3C are quarter-sectional views of consecutive axial sections of a packer assembly having opposing barrel slips that divert axial loading to the wellbore in accordance with an embodiment of the present invention in a set configuration.
Figure 2B:
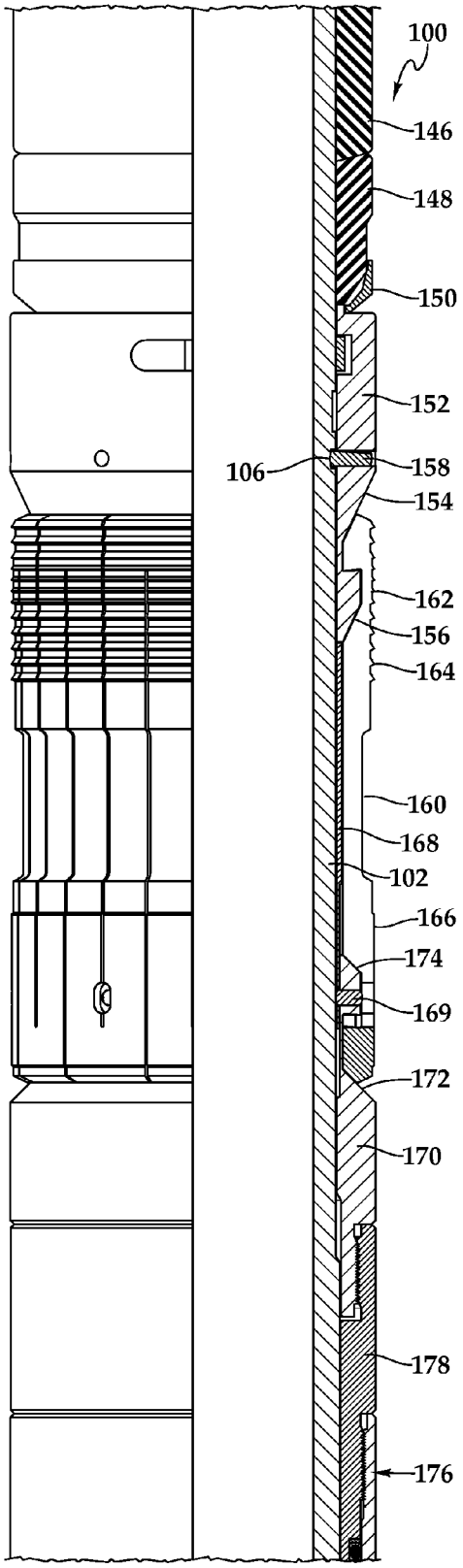
Figure 3B:
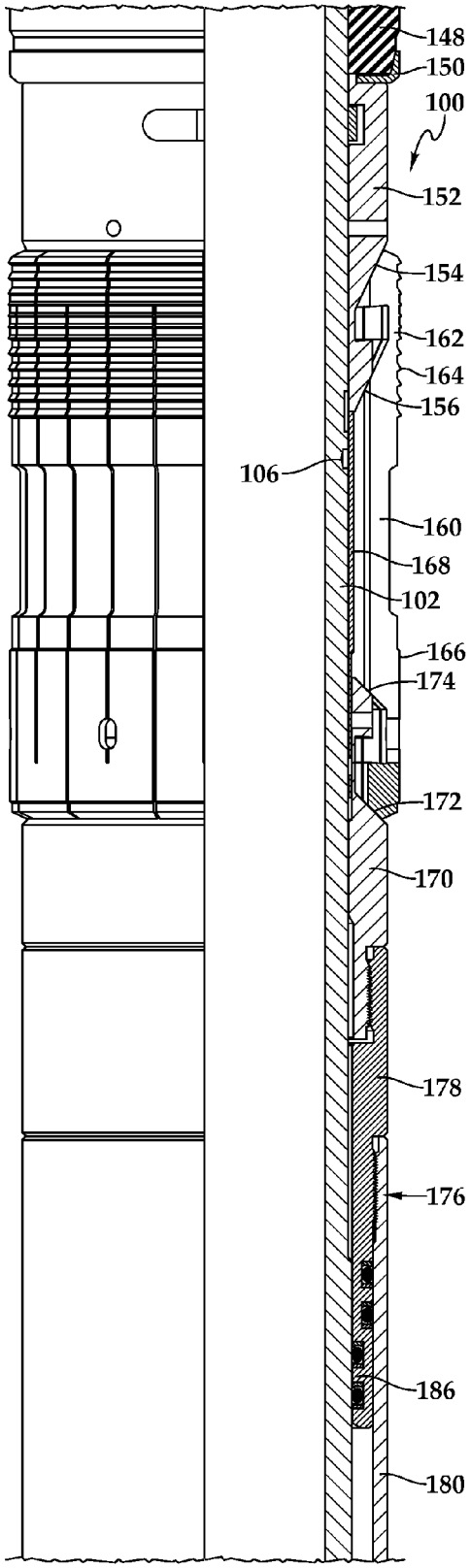
Figure 2C:
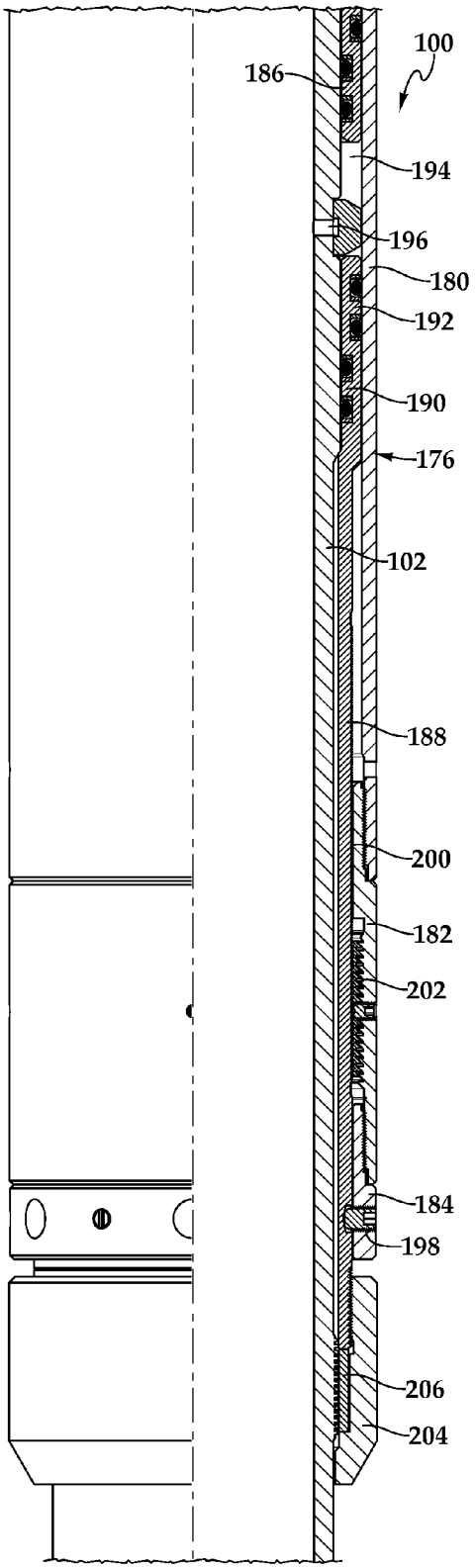
Figure 3C:
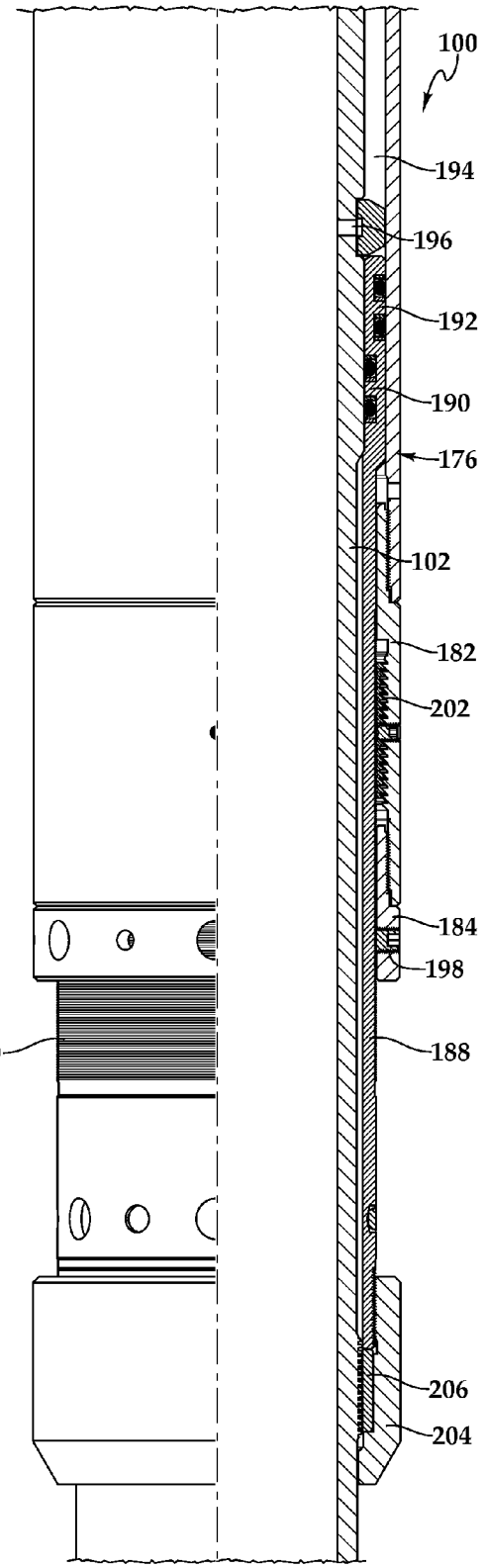

Referring now to FIGS. 2A-2C, therein are depicted successive axial sections of a packer assembly having opposing barrel slips that divert axial loading to the wellbore that is representatively illustrated and generally designated 100. Packer assembly 100 may be threadably coupled to other downhole tools as part of a tubular string as described above. Packer assembly 100 includes a packer mandrel 102. Packer mandrel 102 includes a pin groove 104, as best seen in FIG. 2A and a pin groove 106, as best seen in FIG. 2B. Positioned around an upper portion of packer mandrel 102 is an upper housing section 108 that is threadably coupled to packer mandrel 102. One or more threaded pins 110 may be used to secure upper housing section 108 against rotation. At its lower end, upper housing section 108 is securably coupled by one or more pins 112 to a wedge 114 that is disposed about packer mandrel 102. Wedge 114 includes a pair of ramps 116, 118 that are operable to engage an inner surface of an upper slip element 120 that is disposed about packer mandrel 102. Upper slip element 120 includes a substantially cylindrical non directional contact surface 122 for diverting force to the well casing when set and a substantially cylindrical directional gripping surface 124 depicted as including a plurality of teeth 126 for providing a gripping arrangement with the interior of the well casing when set. As illustrated, upper slip element 120 is located between wedge 114 and a wedge 130 that includes a pair of ramps 132, 134. In the running configuration of packer assembly 100 depicted in FIGS. 2A-2C, wedge 130 is securably coupled to packer mandrel 102 by one or more pins 136. In addition, upper slip element 120 is prevented from moving up ramp 132 of wedge 130 by one or more pins 138. As explained in greater detail below, when a compressive force is generated between wedge 114, upper slip element 120 and wedge 130, upper slip element 120 is radially expanded into contact with the well casing.

Substantially adjacent to wedge 130 is an upper element backup shoe 140 that is slidably positioned around packer mandrel 102. Additionally, a seal assembly 142, depicted as expandable seal elements 144, 146, 148, is slidably positioned around packer mandrel 102 between upper element backup shoe 140 and a lower element backup shoe 150. Even though three expandable seal elements 144, 146, 148 are depicted and described, those skilled in the art will recognizes that a seal assembly of the packer of the present invention may include any number of seal elements.

Upper element backup shoe 140 and lower element backup shoe 150 may be made from a deformable or malleable material, such as mild steel, soft steel, brass and the like and may be thin cut at their distal ends. The ends of upper element backup shoe 140 and lower element backup shoe 150 will deform and flare outwardly toward the inner surface of the casing during setting. In one embodiment, upper element backup shoe 140 and lower element backup shoe 150 form metal-to-metal barriers between packer assembly 100 and the inner surface of the casing.

Another wedge 152 including a pair of ramps 154, 156 is disposed about packer mandrel 102. In the running configuration of packer assembly 100 depicted in FIGS. 2A-2C, wedge 152 is securably coupled to packer mandrel 102 by one or more pins 158. Below wedge 152 is a lower slip element 160 that is disposed about packer mandrel 102. Lower slip element 160 includes a substantially cylindrical directional gripping surface 162 depicted as including a plurality of teeth 164 for providing a gripping arrangement with the interior of the well casing when set and a substantially cylindrical non directional contact surface 166 for diverting force to the well casing when set. Disposed between lower slip element 160 and packer mandrel 102 is a force ring 168. Lower slip element 160 is located between wedge 152 and a wedge 170 including a pair of ramps 172, 174 that are operable to engage an inner surface of lower slip element 160. Initially, wedge 170 is coupled to force ring 168 by one or more pins 169. As explained in greater detail below, when a compressive force is generated between wedge 152, lower slip element 160 and wedge 170, lower slip element 160 is radially expanded into contact with the well casing.

A setting piston assembly 176 is slidably disposed about packer mandrel 102 and coupled to wedge 170 through a threaded connection. In the illustrated embodiment, piston assembly 176 includes an upper piston section 178, an intermediate piston section 180 that is threadably and sealingly coupled to upper piston section 178, a lower piston section 182 that is threadably coupled to intermediate piston section 180 and a retainer ring 184 that is threadably coupled to lower piston section 182. Even though piston assembly 176 is depicted and describes as having a particular number of sections, those skilled in the art will recognize that other arrangements of piston sections including a greater number or lesser number of piston sections including a single piston section could alternatively be used in the present invention. Upper piston section 178 includes a sealing profile 186 having multiple sealing elements that provide a seal with packer mandrel 102.

A lower cylinder 188 is disposed between packer mandrel 102 and the lower sections of piston assembly 176. Lower cylinder 188 includes a sealing profile 190 having multiple sealing elements that provide a seal with packer mandrel 102. Lower cylinder 188 also includes a sealing profile 192 having multiple sealing elements that provide a seal with intermediate piston section 180. Packer mandrel 102 and intermediate piston section 180 as well as the seals of upper piston section 178 and lower cylinder 188 define a setting chamber 194 that is in fluid communication with one or more fluid ports 196 that extend through packer mandrel 102. Retainer ring 184 is initially coupled to lower cylinder 188 by one or more frangible members depicted as shear screws 198. Lower cylinder 188 includes a serrated outer surface 200 that is operable to interact with a body lock ring 202 disposed between lower cylinder 188 and lower piston section 182. At its lower end, lower cylinder 188 is threadably coupled to a lower housing section 204. Disposed between lower housing section 204 and packer mandrel 102 is a lock ring 206 that locates lower housing section 204 on packer mandrel 102.

Referring collectively to FIGS. 2A-2D and 3A-3D an operating mode of packer assembly 100 will now be described. Packer assembly 100 is shown before and after activation and expansion of expandable seal elements 144, 146, 148 and slip elements 120, 160, respectively, in FIGS. 2A-2D and 3A-3D. Packer assembly 100 may be run into a wellbore on a work string or similar tubular string to a desired depth and then set against a casing string, a liner string or other wellbore surface. Setting is accomplished by increasing the tubing pressure within packer mandrel 102 and setting chamber 194 to an actuation pressure sufficient to upwardly shift setting piston assembly 176. The force generated by the fluid pressure acting on a lower surface of setting piston assembly 176 breaks the shear screws 198 allowing setting piston assembly 176 to move upwardly relative to lower cylinder 188 and packer mandrel 102.

The upwardly directed force breaks pins 158 and pins 136 releasing slip elements 120, 160 from packer mandrel 102. The upwardly moving setting piston assembly 176 causes wedge 130 to move toward wedge 114 causing slip element 120 to be radially outwardly shifted as by ramps 116, 118, 132, 134, which sets slip element 120 against the setting surface of the wellbore. As slip element 120 sets, greater force is applied between wedge 130 and wedge 152. This applies a compressive force against seal assembly 142, which causes radial expansion of seal elements 144, 146, 148 against the sealing surface of the wellbore. In addition, the compressive forces causes upper element backup shoe 140 and lower element backup shoe 150 to flare outward toward the sealing surface to provide a metal-to-metal seal against a casing or liner string. As seal assembly 142 sets, greater force is applied between wedge 170 and force ring 168, which breaks pins 169 releasing wedge 170 from force ring 168. The upwardly moving setting piston assembly 176 now causes wedge 170 to move toward wedge 152 causing slip element 160 to be radially outwardly shifted as by ramps 154, 156, 172, 174, which sets slip element 160 against the setting surface of the wellbore. After setting, downward movement of piston assembly 176 is prevented due to the interaction of body lock ring 202 and serrated outer surface 200 of lower cylinder 188.

In this manner, packer assembly 100 creates a sealing relationship between seal elements 144, 146, 148 and the sealing surface of the wellbore. In addition, packer assembly 100 create a gripping relationship between directional gripping surface 124 of slip element 120, directional gripping surface 162 of slip element 160 and setting surfaces of the wellbore. Further, packer assembly 100 create a contact relationship between non directional contact surface 122 of slip element 120, non directional contact surface 166 of slip element 160 and setting surfaces of the wellbore. In this set configuration, directional gripping surface 124 of slip element 120 opposes movement of slip element 120 in the uphole direction and directional gripping surface 162 of slip element 160 opposes movement of slip element 160 in the downhole direction. In addition, in this set configuration, non directional contact surface 122 of slip element 120 diverts force acting on slip element 120 in the downhole direction to the wellbore and non directional contact surface 166 of slip element 160 diverts force acting on slip element 160 in the uphole direction to the wellbore.

Figure 4A:
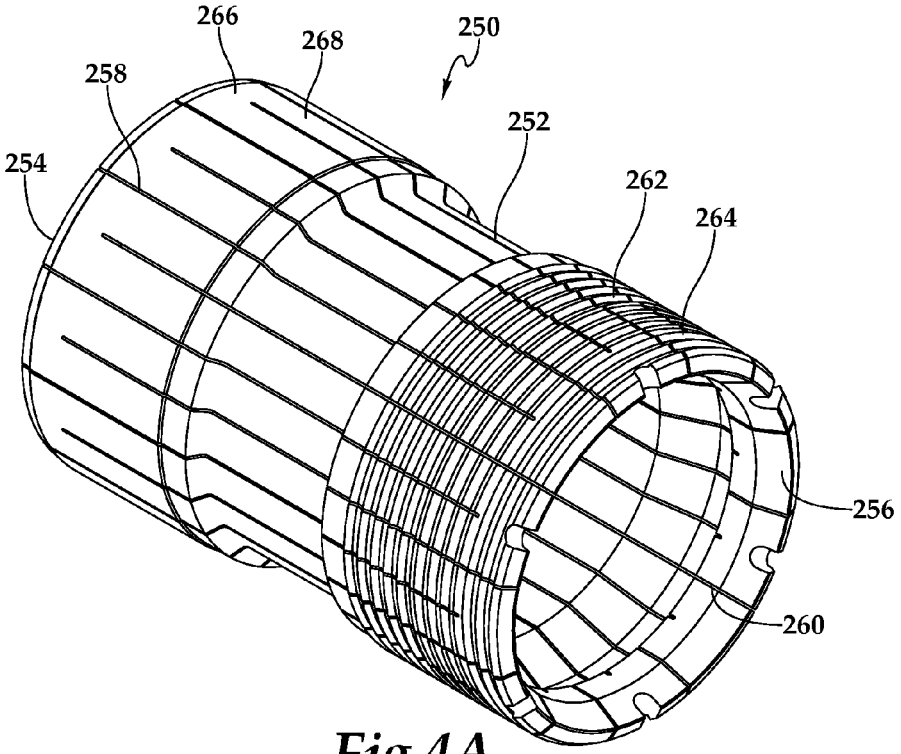
FIGS. 4A-4B are isometric views of barrel slips for use in a packer assembly having opposing barrel slips that divert axial loading to the wellbore in accordance with an embodiment of the present invention.

Referring next to FIG. 4A, therein is depicted an upper slip element for use in a packer assembly having opposing barrel slips that divert axial loading to the wellbore in accordance with an embodiment of the present invention. Upper slip element 250 includes a radially expandable barrel slip body 252 having an upper end 254 and a lower end 256. In the illustrated embodiment, barrel slip body 252 has a plurality of longitudinal slots 258 extending from upper end 254 and terminating near lower end 256. Likewise, barrel slip body 252 has a plurality of longitudinal slots 260 extending from lower end 256 and terminating near upper end 254. The slotted assembly of barrel slip body 252 enables barrel slip body 252 to be radially outwardly expanded responsive to the setting force described above and also enables barrel slip body 252 to return to its radially contracted state when the setting force is removed. Upper slip element 250 includes a substantially cylindrical directional gripping surface 262 disposed on the exterior thereof proximate lower end 256. In the illustrated embodiment, substantially cylindrical directional gripping surface 262 is depicted as a plurality of teeth 264. Upper slip element 250 also includes a substantially cylindrical non directional contact surface 266 disposed on the exterior thereof proximate upper end 254. In the illustrated embodiment, substantially cylindrical non directional contact surface 266 is depicted as having a substantially smooth finish 268.

Figure 4B:
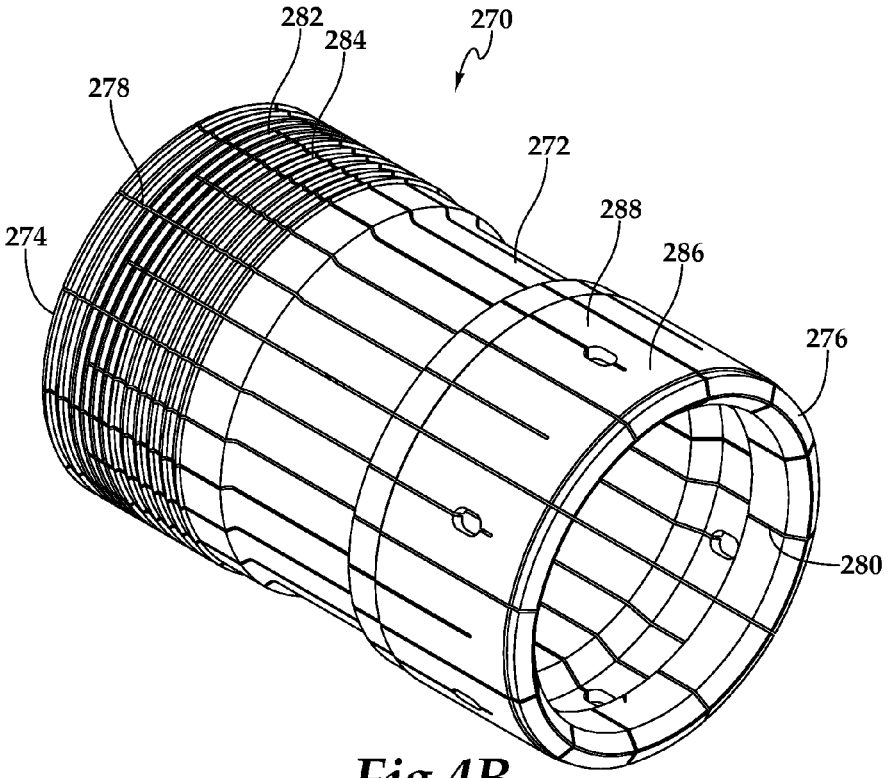

Referring next to FIG. 4B, therein is depicted a lower slip element for use in a packer assembly having opposing barrel slips that divert axial loading to the wellbore in accordance with an embodiment of the present invention. Lower slip element 270 includes a radially expandable barrel slip body 272 having an upper end 274 and a lower end 276. In the illustrated embodiment, barrel slip body 272 has a plurality of longitudinal slots 278 extending from upper end 274 and terminating near lower end 276. Likewise, barrel slip body 272 has a plurality of longitudinal slots 280 extending from lower end 276 and terminating near upper end 274. The slotted assembly of barrel slip body 272 enables barrel slip body 272 to be radially outwardly expanded responsive to the setting force described above and also enables barrel slip body 272 to return to its radially contracted state when the setting force is removed. Lower slip element 270 includes a substantially cylindrical directional gripping surface 282 disposed on the exterior thereof proximate upper end 274. In the illustrated embodiment, substantially cylindrical directional gripping surface 282 is depicted as a plurality of teeth 284. Lower slip element 270 also includes a substantially cylindrical non directional contact surface 286 disposed on the exterior thereof proximate lower end 276. In the illustrated embodiment, substantially cylindrical non directional contact surface 286 is depicted as having a substantially smooth finish 288.

Figure 5A:
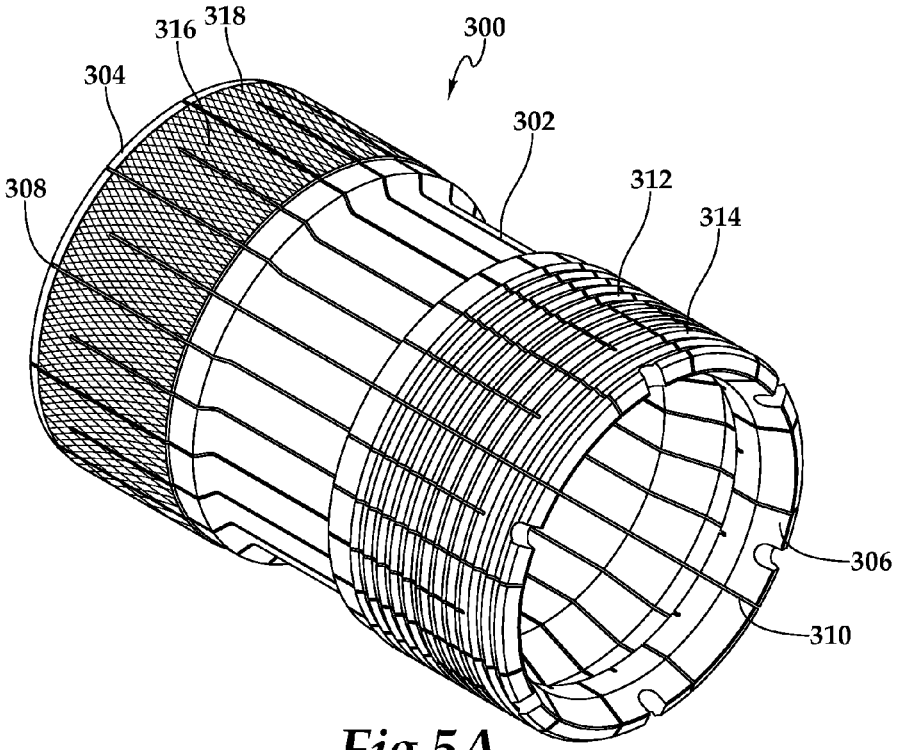
FIGS. 5A-5B are isometric views of barrel slips for use in a packer assembly having opposing barrel slips that divert axial loading to the wellbore in accordance with an embodiment of the present invention.

Referring next to FIG. 5A, therein is depicted an upper slip element for use in a packer assembly having opposing barrel slips that divert axial loading to the wellbore in accordance with an embodiment of the present invention. Upper slip element 300 includes a radially expandable barrel slip body 302 having an upper end 304 and a lower end 306. In the illustrated embodiment, barrel slip body 302 has a plurality of longitudinal slots 308 extending from upper end 304 and terminating near lower end 306. Likewise, barrel slip body 302 has a plurality of longitudinal slots 310 extending from lower end 306 and terminating near upper end 304. The slotted assembly of barrel slip body 302 enables barrel slip body 302 to be radially outwardly expanded responsive to the setting force described above and also enables barrel slip body 302 to return to its radially contracted state when the setting force is removed. Upper slip element 300 includes a substantially cylindrical directional gripping surface 312 disposed on the exterior thereof proximate lower end 306. In the illustrated embodiment, substantially cylindrical directional gripping surface 312 is depicted as a plurality of teeth 314. Upper slip element 300 also includes a substantially cylindrical non directional contact surface 316 disposed on the exterior thereof proximate upper end 304. In the illustrated embodiment, substantially cylindrical non directional contact surface 316 is depicted as having a friction enhancing finish 318 created, for example, by knurled, threading, abrasive blasting, grinding, roughing, etching or other mechanical, chemical or electrical process.

Figure 5B:
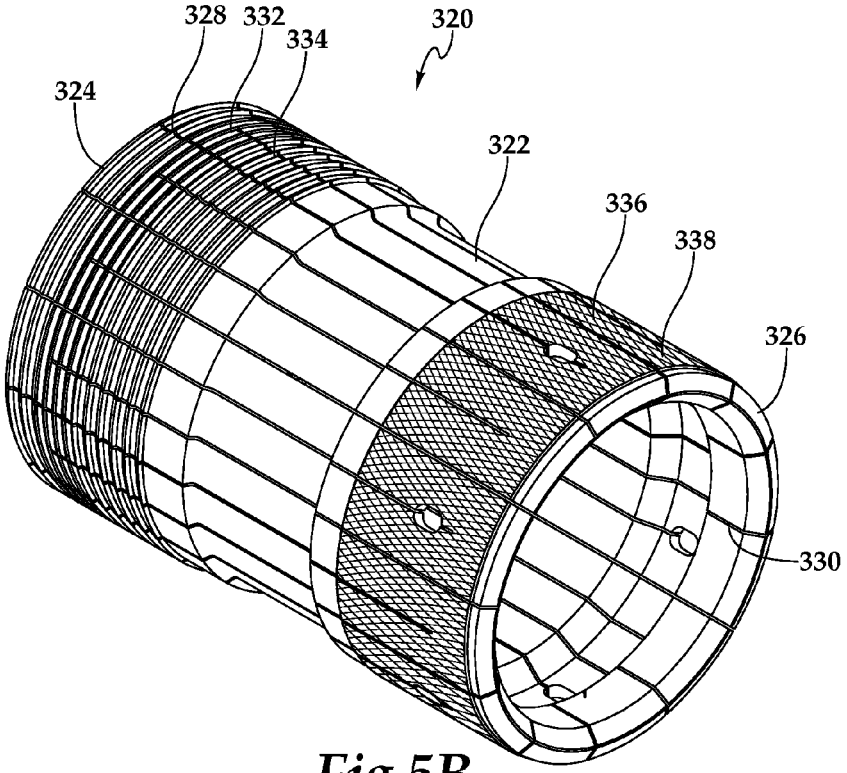

Referring next to FIG. 5B, therein is depicted a lower slip element for use in a packer assembly having opposing barrel slips that divert axial loading to the wellbore in accordance with an embodiment of the present invention. Lower slip element 320 includes a radially expandable barrel slip body 322 having an upper end 324 and a lower end 326. In the illustrated embodiment, barrel slip body 322 has a plurality of longitudinal slots 328 extending from upper end 324 and terminating near lower end 326. Likewise, barrel slip body 322 has a plurality of longitudinal slots 330 extending from lower end 326 and terminating near upper end 324. The slotted assembly of barrel slip body 322 enables barrel slip body 322 to be radially outwardly expanded responsive to the setting force described above and also enables barrel slip body 322 to return to its radially contracted state when the setting force is removed. Lower slip element 320 includes a substantially cylindrical directional gripping surface 332 disposed on the exterior thereof proximate upper end 324. In the illustrated embodiment, substantially cylindrical directional gripping surface 332 is depicted as a plurality of teeth 334. Lower slip element 320 also includes a substantially cylindrical non directional contact surface 336 disposed on the exterior thereof proximate lower end 326. In the illustrated embodiment, substantially cylindrical non directional contact surface 336 is depicted as having a friction enhancing finish 338 created, for example, by knurled, threading, abrasive blasting, grinding, roughing, etching or other mechanical, chemical or electrical process.

Figure 6A:
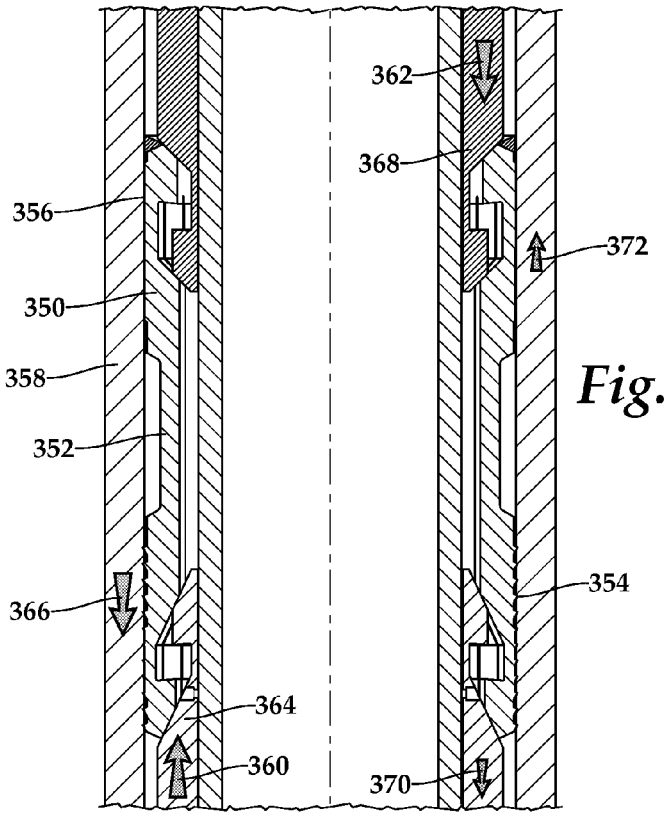
FIGS. 6A-6B are cross-sectional views of barrel slips engaged with a wellbore surface in accordance with an embodiment of the present invention.

Referring next to FIG. 6A, therein is depicted an upper slip element for use in a packer assembly having opposing barrel slips that divert axial loading to the wellbore in accordance with an embodiment of the present invention. Upper slip element 350 includes a radially expandable barrel slip body 352 having an upper end and a lower end. Upper slip element 350 includes a substantially cylindrical directional gripping surface 354 disposed on the exterior thereof proximate the lower end. Upper slip element 350 also includes a substantially cylindrical non directional contact surface 356 disposed on the exterior thereof proximate the upper end. As illustrated, upper slip element 350 has been set in a casing 358 of a wellbore. The left side of the figure depicts a force 360 being applied to upper slip element 350 in the uphole direction, while the right side of the figure depicts a force 362 being applied to upper slip element 350 in the downhole direction. It should be understood by those skilled in the art that the force diagram is not intended to show that the force 360 in the uphole direction and the force 362 in the downhole direction are being applied simultaneously. Instead, the left side of the diagram represents a time period when a force 360 in the uphole direction is applied and the reaction thereto by upper slip element 350 and casing 358. Likewise, the right side of the diagram represents a time period when a force 362 in the downhole direction is applied and the reaction thereto by upper slip element 350 and casing 358.

Referring first to the left side of FIG. 6A, force 360 is being applied to upper slip element 352 in the uphole direction. As illustrated, the force is being applied from wedge 364 on the lower end of upper slip element 352. Due to the interaction of the substantially cylindrical directional gripping surface 354 of upper slip element 352 and the inner surface of casing 358, movement of upper slip element 352 in the uphole direction is opposed and a substantially equal and opposite force 366 is depicted in casing 358. Referring next to the right side of FIG. 6A, force 362 is being applied to upper slip element 352 in the downhole direction. As illustrated, the force is being applied from wedge 368 on the upper end of upper slip element 352. Due to the interaction of the substantially cylindrical non directional contact surface 356 of upper slip element 352 and the inner surface of casing 358, a portion of the force transmitted through upper slip element 352 to wedge 364 as indicated by arrow 370 and a second portion of the force is diverted into casing 358 as indicated by oppositely directed arrow 372. Use of upper slip element 352 enables a portion of the force in the downhole direction to be diverted into the wellbore, which prevents this force from be transmitted through upper slip element 352 and wedge 364 to the seal elements (not pictured). As described above, force that is transmitted to the seal elements results in combined loading on the packer mandrel proximate the seal elements caused by differential pressures and the applied axial forces which can result in collapse the packer mandrel. As upper slip element 352 is operable to divert a portion of the applied downhole force, a packer assembly of the present invention is operable for use in higher pressure environments wherein higher applied forces may be seen by a packer assembly.

Figure 6B:
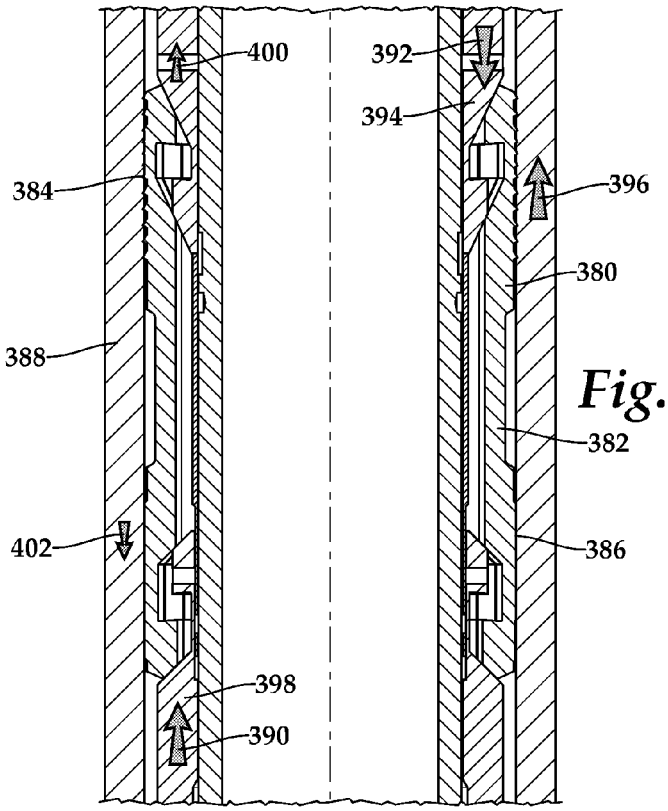

Referring next to FIG. 6B, therein is depicted a lower slip element for use in a packer assembly having opposing barrel slips that divert axial loading to the wellbore in accordance with an embodiment of the present invention. Lower slip element 380 includes a radially expandable barrel slip body 382 having an upper end and a lower end. Lower slip element 380 includes a substantially cylindrical directional gripping surface 384 disposed on the exterior thereof proximate the upper end. Lower slip element 380 also includes a substantially cylindrical non directional contact surface 386 disposed on the exterior thereof proximate the lower end. As illustrated, lower slip element 380 has been set in a casing 388 of a wellbore. The left side of the figure depicts a force 390 being applied to lower slip element 380 in the uphole direction, while the right side of the figure depicts a force 392 being applied to lower slip element 380 in the downhole direction.

Referring first to the right side of FIG. 6B, force 392 is being applied to lower slip element 382 in the downhole direction. As illustrated, the force is being applied from wedge 394 on the upper end of lower slip element 382. Due to the interaction of the substantially cylindrical directional gripping surface 384 of lower slip element 382 and the inner surface of casing 388, movement of lower slip element 380 in the downhole direction is opposed and a substantially equal and opposite force is depicted as arrow 396 in casing 388. Referring next to the left side of FIG. 6B, force 390 is being applied to lower slip element 380 in the uphole direction. As illustrated, the force is being applied from wedge 398 on the lower end of lower slip element 380. Due to the interaction of the substantially cylindrical non directional contact surface 386 of lower slip element 380 and the inner surface of casing 388, a portion of the force is transmitted through lower slip element 380 to wedge 394 as indicated by arrow 400 and a second portion of the force is diverted into casing 388 as indicated by oppositely directed arrow 402. Use of lower slip element 380 enables a portion of the force in the uphole direction to be diverted into the wellbore, which prevents this force from be transmitted through lower slip element 380 and wedge 394 to the seal elements (not pictured). As described above, force that is transmitted to the seal elements results in combined loading on the packer mandrel proximate the seal elements caused by the differential pressures and the applied axial forces, which can result in collapse the packer mandrel. As lower slip element 380 is operable to divert a portion of the applied uphole force to the wellbore, a packer assembly of the present invention is operable for use in higher pressure environments wherein higher applied forces may be seen by a packer assembly.

The surface characteristics of the wellbore and the non directional contact surfaces of the slip elements will, at least in part, determine the degree or percentage of the applied force that will be diverted into the wellbore. For example, a non directional contact surface having a substantially smooth finish may divert between about ten percent to about twenty five percent or more of the applied force to the wellbore. As another example, a non directional contact surface having a friction enhancing finish may divert between about twenty five percent to about fifty percent or more of the applied force to the wellbore. As such, depending upon the desired amount of force to be diverted, one skilled in the art can select the desired surface characteristics for the non directional contact surfaces.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A packer assembly for use in a wellbore comprising:

a packer mandrel;

a first barrel slip disposed about the packer mandrel, the first barrel slip having a first substantially cylindrical directional gripping surface with teeth and a first substantially cylindrical non directional contact surface without teeth;

a second barrel slip disposed about the packer mandrel, the second barrel slip having a second substantially cylindrical directional gripping surface with teeth and a second substantially cylindrical non directional contact surface without teeth; and a seal assembly disposed about the packer mandrel between the first and second barrel slips;

wherein, in a set configuration, radial expansion of the seal assembly creates a sealing engagement between the seal assembly and the wellbore;

wherein, in the set configuration, radial expansion of the first barrel slip creates a gripping engagement between the first directional gripping surface and the wellbore that opposes movement of the first barrel slip in a first direction;

wherein, in the set configuration, radial expansion of the first barrel slip creates a contact engagement between the first non directional contact surface and the wellbore that diverts, to the wellbore, at least a portion of a force acting on the first barrel slip in a second direction, thereby preventing the at least a portion of the force acting on the first barrel slip in the second direction from acting axially on the seal assembly;

wherein, in the set configuration, radial expansion of the second barrel slip creates a gripping engagement between the second directional gripping surface and the wellbore that opposes movement of the second barrel slip in the second direction; and wherein, in the set configuration, radial expansion of the second barrel slip creates a contact engagement between the second non directional contact surface and the wellbore that diverts, to the wellbore, at least a portion of a force acting on the second barrel slip in the first direction, thereby preventing the at least a portion of the force acting on the second barrel slip in the first direction from acting axially on the seal assembly; and wherein the first and second barrel slips each further comprises a radially expandable barrel slip body having a first end, a second end, a plurality of first longitudinal slots extending from the first end and terminating near the second end and a plurality of second longitudinal slots extending from the second end and terminating near the first end.

2. The packer assembly as recited in claim 1 further comprising a setting piston slidably disposed about the packer mandrel forming a setting chamber therebetween.

3. The packer assembly as recited in claim 2 wherein pressurizing the setting chamber actuates the setting piston to shift the packer assembly from a running configuration to the set configuration.

4. The packer assembly as recited in claim 1 wherein each of the first and second directional gripping surfaces further comprises a substantially cylindrical surface having a plurality of teeth and wherein each of the first and second non directional contact surfaces further comprises a substantially cylindrical surface having a substantially smooth finish.

5. The packer assembly as recited in claim 1 wherein each of the first and second directional gripping surfaces further comprises a substantially cylindrical surface having a plurality of teeth and wherein each of the first and second non directional contact surfaces further comprises a substantially cylindrical surface having a friction enhancing finish.

6. The packer assembly as recited in claim 1 wherein the at least a portion of the force acting on the first barrel slip in the second direction diverted by the first non directional contact surface to the wellbore is at least ten percent of the force acting on the first barrel slip in the second direction and wherein the at least a portion of the force acting on the second barrel slip in the first direction diverted by the second non directional contact surface to the wellbore is at least ten percent of the force acting on the second barrel slip in the first direction.

7. The packer assembly as recited in claim 1 wherein the at least a portion of the force acting on the first barrel slip in the second direction diverted by the first non directional contact surface to the wellbore is at least twenty five percent of the force acting on the first barrel slip in the second direction and wherein the at least a portion of the force acting on the second barrel slip in the first direction diverted by the second non directional contact surface to the wellbore is at least twenty five percent of the force acting on the second barrel slip in the first direction.

8. The packer assembly as recited in claim 1 wherein the at least a portion of the force acting on the first barrel slip in the second direction diverted by the first non directional contact surface to the wellbore is at least fifty percent of the force acting on the first barrel slip in the second direction and wherein the at least a portion of the force acting on the second barrel slip in the first direction diverted by the second non directional contact surface to the wellbore is at least fifty percent of the force acting on the second barrel slip in the first direction.

9. A barrel slip for a packer assembly operable for use in a wellbore comprising:

a radially expandable barrel slip body having a first end, a second end, a plurality of first longitudinal slots extending from the first end and terminating near the second end and a plurality of second longitudinal slots extending from the second end and terminating near the first end;

a substantially cylindrical directional gripping surface with teeth disposed on an exterior of the barrel slip body proximate the first end; and a substantially cylindrical non directional contact surface without teeth disposed on the exterior of the barrel slip body proximate the second end;

wherein, in a set configuration, radial expansion of the barrel slip body creates a gripping engagement between the directional gripping surface and the wellbore that opposes movement of the barrel slip body in a first direction; and wherein, in the set configuration, radial expansion of the barrel slip body creates a contact engagement between the non directional contact surface and the wellbore that transfers, to the wellbore, at least a portion of a force acting on the barrel slip body in a second direction.

10. The barrel slip as recited in claim 9 wherein the directional gripping surface further comprises a plurality of teeth and wherein the non directional contact surface further comprises a substantially smooth finish.

11. The barrel slip as recited in claim 9 wherein the directional gripping surface further comprises a plurality of teeth and wherein the non directional contact surface further comprises a friction enhancing finish.

12. The barrel slip as recited in claim 9 wherein the at least a portion of the force transferred to the wellbore by the non directional contact surface is at least ten percent of the force acting on the barrel slip body in the second direction.

13. The barrel slip as recited in claim 9 wherein the at least a portion of the force transferred to the wellbore by the non directional contact surface is at least twenty five percent of the force acting on the barrel slip body in the second direction.

14. The barrel slip as recited in claim 9 wherein the at least a portion of the force transferred to the wellbore by the non directional contact surface is at least fifty percent of the force acting on the barrel slip body in the second direction.

15. A method for diverting axial loading to a wellbore from a packer assembly, the method comprising:

providing a packer assembly having a packer mandrel with a seal assembly, a first barrel slip and a second barrel slip disposed thereabout;

running the packer assembly into the wellbore;

actuating the packer assembly from a running configuration to a set configuration;

establishing a sealing engagement between the seal assembly and the wellbore;

establishing a gripping engagement between a substantially cylindrical directional gripping surface with teeth of the first barrel slip and the wellbore that opposes movement of the first barrel slip in a first direction;

establishing a contact engagement between a substantially cylindrical non directional contact surface without teeth of the first barrel slip and the wellbore that diverts, to the wellbore, at least a portion of a force acting on the first barrel slip in a second direction, preventing the at least a portion of the force acting on the first barrel slip in the second direction from acting axially on the seal assembly;

establishing a gripping engagement between a substantially cylindrical directional gripping surface with teeth of the second barrel slip and the wellbore that opposes movement of the second barrel slip in the second direction; and establishing a contact engagement between a substantially cylindrical non directional contact surface without teeth of the second barrel slip and the wellbore that diverts, to the wellbore, at least a portion of a force acting on the second barrel slip in the first direction, thereby preventing the at least a portion of the force acting on the second barrel slip in the first direction from acting axially on the seal assembly; and wherein the first and second barrel slips each further comprises a radially expandable barrel slip body having a first end, a second end, a plurality of first longitudinal slots extending from the first end and terminating near the second end and a plurality of second longitudinal slots extending from the second end and terminating near the first end.

16. The method as recited in claim 15 wherein actuating the packer assembly from the running configuration to the set configuration further comprising pressurizing a setting chamber to shift a setting piston.

17. The method as recited in claim 15 wherein establishing the gripping engagement between the directional gripping surface of the first barrel slip and the wellbore further comprises engaging a substantially cylindrical surface having a plurality of teeth of the first barrel slip and the wellbore and wherein establishing the gripping engagement between the directional gripping surface of the second barrel slip and the wellbore further comprises engaging a substantially cylindrical surface having a plurality of teeth of the second barrel slip and the wellbore.

18. The method as recited in claim 15 wherein establishing the contact engagement between the non directional contact surface of the first barrel slip and the wellbore further comprises engaging a substantially cylindrical surface having a substantially smooth finish of the first barrel slip and the wellbore and wherein establishing the contact engagement between the non directional contact surface of the second barrel slip and the wellbore further comprises engaging a substantially cylindrical surface having a substantially smooth finish of the second barrel slip and the wellbore.

19. The method as recited in claim 15 wherein establishing the contact engagement between the non directional contact surface of the first barrel slip and the wellbore further comprises engaging a substantially cylindrical surface having a friction enhancing finish of the first barrel slip and the wellbore and wherein establishing the contact engagement between the non directional contact surface of the second barrel slip and the wellbore further comprises engaging a substantially cylindrical surface having a friction enhancing finish of the second barrel slip and the wellbore.

* * * * *